United States Patent [19]

Svaty

[11] 3,977,441

[45] Aug. 31, 1976

[54] DEVICE FOR RECORDING WEAVING FAULTS

[75] Inventor: Vladimír Svatý, Liberec, Czechoslovakia

[73] Assignee: Elitex, Zavody textilniho strojirenstvi generalni reditalstvi, Liberec, Czechoslovakia

[22] Filed: Aug. 23, 1971

[21] Appl. No.: 173,816

[30] Foreign Application Priority Data

Aug. 26, 1970 Czechoslovakia ..... 5852-70

[52] U.S. Cl. ..... 139/1 R; 139/336

[51] Int. Cl.[2] ..... D03D 51/06

[58] Field of Search ..... 139/1 R, 11, 336, 291 R; 346/33, 103, 138

[56] References Cited

UNITED STATES PATENTS

| | | | |
|---|---|---|---|
| 258,672 | 5/1882 | Pouget | 346/103 |
| 1,317,321 | 9/1919 | Ryberg | 346/103 |
| 3,417,916 | 12/1968 | Brockel et al. | 139/1 R |
| 3,459,235 | 8/1969 | Cauthen et al. | 139/1 R |
| 3,613,743 | 10/1971 | Sakamoto | 139/336 |

*Primary Examiner*—Henry S. Jaudon
*Attorney, Agent, or Firm*—Murray Schaffer

[57] ABSTRACT

Device for recording weaving faults in fabric being manufactured on weaving machines in which a recording card is fixed to a drum means and has associated therewith writing means that are initiated through an electro-magnet and circuitry connected to at least one stop motion on the stop circuit of the weaving machine.

The drum which supports the recording card is rotated at the same speed as the advancing fabric being manufactured on the weaving machine through a transmission coupling the drum to means on the weaving machine such as the withdrawal cylinder.

6 Claims, 3 Drawing Figures

INVENTOR
VLADIMIR SVATY
BY Murray Schaffer
ATTORNEY

INVENTOR
VLADIMIR SVATY
BY Murry Schaffer
ATTORNEY

INVENTOR
VLADIMIR SVATY
BY Murray Schaffer
ATTORNEY

DEVICE FOR RECORDING WEAVING FAULTS

BACKGROUND OF THE INVENTION

The present invention relates to a device for recording weaving faults in fabric being manufactured on weaving machines. The faults are made on a recording card, the mark recorded indicating the reason for the fault, such as stoppage of the machine by the attendant, breakage of warp or weft threads or similar faults.

The correlation between the quality of woven goods and the number of weaving machine stoppages is well known, particularly in those kinds of fabrics in which each stoppage of the machine leaves a visible trace. Similarly, the correlation between the number of weaving machine stoppages for whatever reason and the efficiency of the weaving machine is known. In order to improve quality and efficiency, there is interest in recording and assessing the reasons of weaving machine stoppages. Consequently, in certain weaving mills the weaving faults are recorded in such a manner that they are noted only upon inspection of the machines and the cause for stoppage is eliminated. At that time, a record is made concerning the weaving faults and one copy is left at the weaving machine for use by the foreman and attendants. However, this method is too time consuming and disadvantages for other reasons also. For example, both the foreman and the attendants of the weaving machine get the record too late, that is after considerable production has already been completed.

Devices for recording and assessing faults in which separate weaving machines are centrally controlled are also known. Devices of this type include a recording apparatus for making a record and means for generating a signal for the recording apparatus, the devices being connected to the separate weaving machines and further provided with means which serve for their connection and interruption of activity. With such types of devices, the record is generated centrally either on one card for all machines controlled thereby or by a series of cards, one belonging to each machine. Such devices are very advantageous in connection with the overall assessment of the records by the dispatcher. For the shop crew, that is, the foreman and the attendants of the weaving machine, however, these records are already disadvantageous, since the information is communicated to them, as in the preceding case, too late, that is, after the final processing of the record. Such devices are also disadvantageous since they are very expensive, and require close attendance and maintenance. In addition, expensive devices for assessing the records made are necessary, too. Without the assessing devices, however, the recording devices are not practical. Consequently smaller plants cannot afford them. There is a need, therefore, for a device for recording weaving faults in fabric made on weaving machines that is relatively simple in construction and which provides immediate data to the foreman and operators and which can be further used for additional processing.

Accordingly, it is an object of this invention to provide a device for recording weaving faults in fabric being manufactured on weaving machines which is of a relatively simple and inexpensive design.

It is still a further object of this invention to provide such a device wherein the recorded data is immediately available to the machine operators and still can be later used for further assessment of the data by a dispatcher or other personnel in another physical location.

It is still another object of the invention to provide such a device in which a recording card is fixed to a drum means having writing means associated therewith and which drum means is linked through a transmission to means on the weaving machine such as the withdrawal cylinder so that the drum and recording card thereon rotate at the same speed as the advancing fabric being manufactured on the weaving machine.

Numerous other objects of the invention will be apparent from the following description and the accompanying drawings.

SUMMARY OF THE INVENTION

The present invention provides a device which mitigates the disadvantages of the known methods and devices to a substantial extent and provides a record that is made directly in the weaving machine and which is also suitable for further processing. In accordance with the invention, there is provided a device in which a recording card is mounted on a drum means that is rotatably fixed on a threaded end of a stationary shaft which is coupled through a transmission means with an element of the weaving machine which moves at a speed identical to that of the advancing fabric, the drum means being provided on its circumference below the recording card with a threaded groove which has the same pitch as the threaded end of the shaft and recording means controlled by electromagnetic means being mounted opposite said groove and connected to circuit means and switch means coupled to at least one stop motion or the stop circuit of the weaving machine.

In order to understand the invention more fully, reference is directed to the following description thereof which is to be taken in conjunction with the accompanying drawings.

Figure 1:
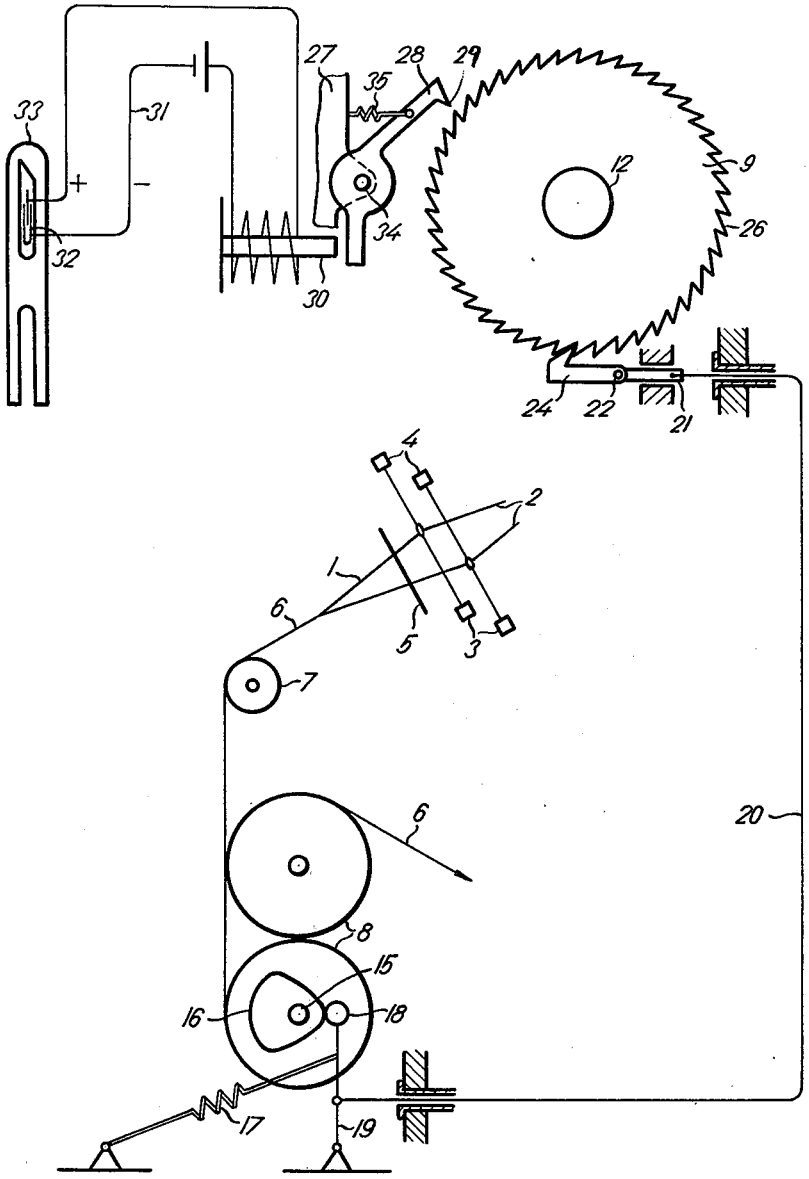
FIG. 1 is a schematic, diagrammatic arrangement of a device in accordance with the invention and its relationship to a weaving machine.

It is to be understood that the device of this invention can be used on any known weaving machine, such as, for example, those shuttless looms disclosed in U.S. patent application Ser. No. 79,035 filed Oct. 8, 1970 and U.S. patent application Ser. No. 79,478 filed Oct. 9, 1970. Consequently, the weaving machine is shown in the drawings only in broad detail in order to illustrate the operative relationship between the device of this invention and such a machine and to avoid the inclusion of complex extraneous subject matter in the drawings.

DESCRIPTION OF THE PREFERRED EMBODIMENT

Attention is now directed to FIG. 1 wherein a typical weaving machine is generally shown and in which the shed 1 formed by the system of warp threads 2 by means of healds 3 suspended in the heald shaft frames 4, is ready to receive a weft thread (not shown) in the known manner. The weft thread constitutes, after beat-up by the reed 5, together with the bound warp threads 2, the fabric 6. The fabric 6 passes over the breast beam 7 and is withdrawn by means of a pair of withdrawing cylinders 8, the operation of which is controlled by a cloth regulator (not shown).

Fabric 6 is next wound on to a cloth beam (not shown). The movement of fabric 6 is recorded best be means of an element of the weaving machine moving at an identical speed as fabric 6, such as one of the withdrawing cylinders 8 and is transmitted through transmission means either intermittently or continuously to a recording device.

The recording device is constituted by a rotatably mounted drum means 9 and at least one recording element. The record is made on a recording card 10. The drive of drum means 9 is illustrated in the form of an intermittent drive.

Drum means 9 is mounted on a threaded end 11 of a stationary shaft 12, and upon turning of the drum, it is simultaneously axially traversed, along the shaft in the direction of the longitudinal axis thereof, similar to a nut being rotated on a screw. About the circumference of drum means 9, there is provded a helical groove 13 having the same pitch as the threaded end 11 of shaft 12. The helical groove 13 on the surface of the drum 9 enables the writing element or elements, three being shown in FIG. 2 and one being identified by numeral 28 to pierce the record card 10 with the tip or tips, three being shown in FIG. 2 and one tip being identified by numeral 29. Consequently, the lead of the groove 13 is made so that it cooperates with the lead of the thread of shaft 12, so that upon rotation of drum 9 the tip 29 or tips of the writing element 28 or pluraltiy thereof are continuously pointed against the groove 13 and move within its confines when the elements are swingably actuated and thus pierce the record card 10. The housing of drum means 9 is further cut by a groove 14 in the direction of the axis of shaft 12 for insertion of the ends off the recording card 10. The length of the helical groove 13 is proportional to the length of the woven goods.

As already mentioned above, an intermittent drive is used for the recording device and is conveniently arranged as follows. On shaft 15 of the withdrawing cylinder 8, a cam 16 provided with at least one projection, is mounted. The drive of fabric 6 is scanned by the cam. A roller 18 is pressed against the circumference of cam 16 by means of spring 17, the roller being mounted on a swingably mounted lever 19, to which one end of the resilient cable 20 is fastened, the other end being firmly connected to an arm 21, on which pawl 24 is swingably mounted by means of pin 22 and screw connection 23. Pawl 24 is pressed by means of spring 25 on pin 22 into engagement with teeth 26 on drum means 9. Arm 21 is mounted swingably on shaft 12 carrying drum means 9.

Figure 2:
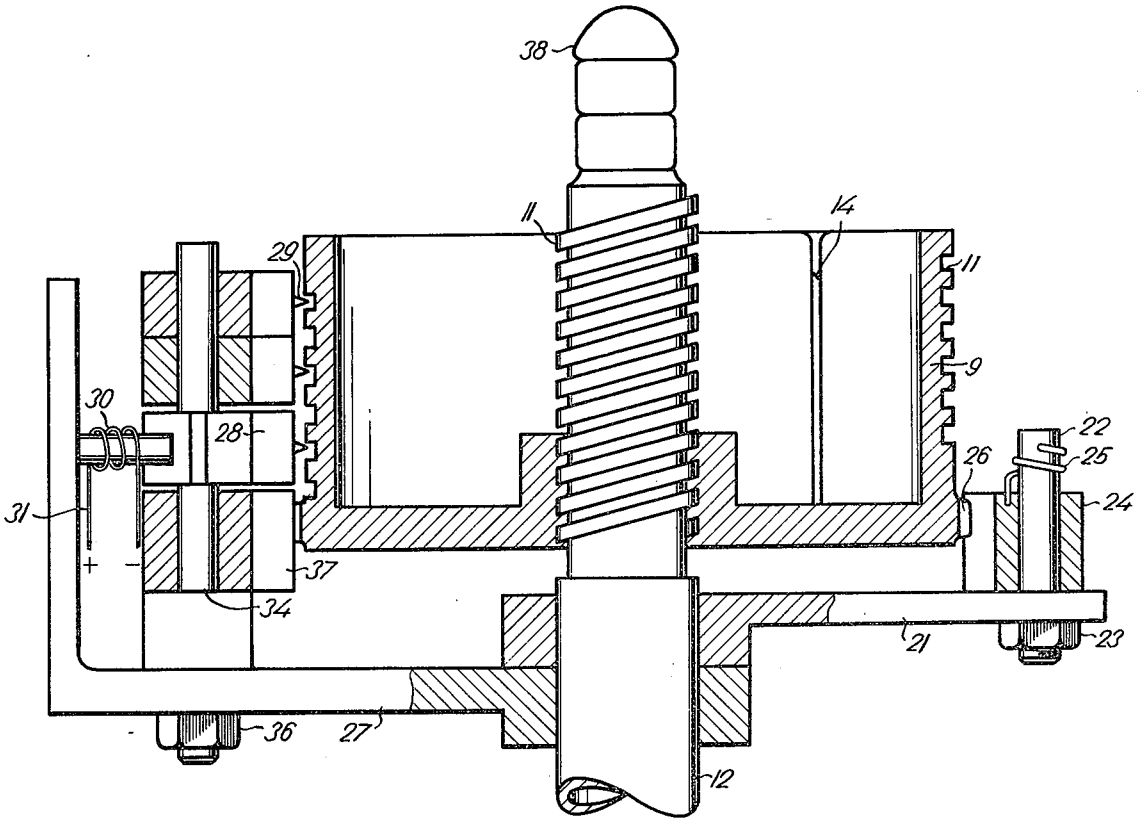
FIG. 2 is a view partially in section showing in detail the drum means, writing means and the threaded shaft on which the drum means is mounted.

One or more recording elements, three being shown in FIG. 2, are carried by a holder 27 fixed to shaft 12 of which one end is bent above drum means 9.

Each recording element includes a writing means 28 which may be of different color, provided with a tip 29 and each writing means 28 is attached to an electromagnet 30, and an associated electric circuit 31 having a switch 32. In the embodiment shown, the switch 32 is attached to one recording element and to the warp stop motion 33. Where a plurality of recording elements are used the switch of each can be attached to the weft stop motion (not shown) or be connected to the stop circuit of the weaving machine.

The writing means on elements 28 of the separate recording elements are mounted swingably beside each other with their tips 29 pointing against the helical groove 13 of drum means 9 on holder 27 by means of pin 34 and are spring loaded by spring 35. Pin 34 is mounted on the holder by a screw connection 36 which also supports a swingably mounted stopping pawl 37 which cooperates with the teeth of the drum means 9 in order to assure the rotation of drum means 9 in only one direction.

The electro-magnets 30 attached to the writing means or elements 28 are mounted directly to the bent part of holder 27 at the respective writing element 28. In FIG. 2, however, as mentioned above, only one electro-magnet 30 is shown.

The device of the present invention operates in the following manner.

The warp beam regulator rotates the withdrawing cylinders 8 and thus also cam 16. The motion of cam 16 is transmitted to roller 18 and by means of a swingably mounted lever 19 and resilient cable 20 to arm 25 and pawl 24, which intermittently rotates drum means 9 and moves it simultaneously in an axial direction about the threaded end 11 of shaft 12 until the weaving machine is stopped at which time the movement of drum means 9 is also interrupted. In the embodiment illustrated, when the weaving machine is stopped due to warp thread breakage, the warp stop motion closes simultaneously with the stopping of the weaving machine and drum means 9 thereby actuating switch 32, which deflects writing element 28 towards drum means 9 and the tip 29 pierces an opening in the record card 10. After eliminating the reason for stoppage of the weaving machine, the warp stop motion 33 is returned to its original position, the electric circuit 31 of electromagnet 30 is opened, writing element 28 returned to its original position and drum means 9 being started to move once again with re-starting of the weaving machine.

The record due to weft thread breakage, or stoppage of the weaving machine is recorded in a like manner except that the record is made on the recording card by writing element 28 of the recording element attached to the weft stop motion or the stop circuit of the weaving machine.

Figure 3:
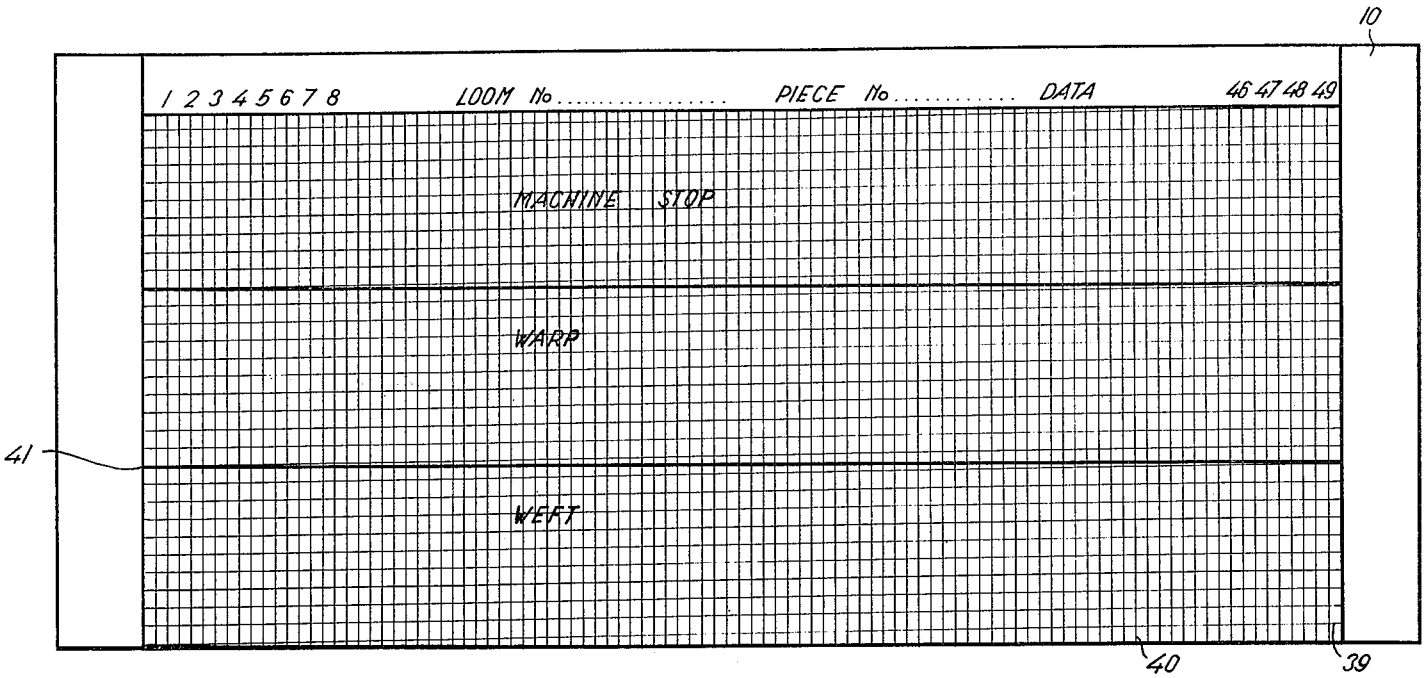
FIG. 3 is a view of a recording card suitable for use with the device and used to record three different types of stoppage date.

It is advantageous when the recorded data are preprinted on the recording card 10 to make an easy evaluation of the record. Card 10, as shown in FIG. 3, is divided into sections by transverse lines 39, which symbolize the number of meters of woven goods during one revolution of drum means 9, and vertical lines 40 which symbolize the number of revolutions of drum means 9. In addition, card 10 is divided by longitudinal lines 41 into three sections indicating the reasons for the weaving machine stoppages, such as weft thread breakage, warp thread breakage and intervention of the attendant. On card 10, data are recorded, also, to indicate on which weaving machine the card was used and which woven piece was made on the machine.

For better guidance of the machine operators, it is advantageous to provide the device with a light signalling means which indicates that a woven piece is finished. In such a case shaft 12 is hollow and lamp 38 and its associated circuitry is located in the end thereof in a known manner.

The present device presents many advantages. For example, it provides a relatively simple, inexpensive design which can be used on known weaving machines without making any overall design changes in the machine. It provides immediate data to the machine operator, as well as data which can be later used by a dispatcher or other personnel in making further assessment of study thereof. Moreover, the device of the invention because of the simplicity of design and relatively small number of moving parts is less susceptible to breaking down and relatively easily repaired when breakdown does occur. Numerous other advantages of the invention will be apparent to those skilled in the art.

It is to be understood that many variations of the embodiments of this invention may be made without departing from the spirit and scope thereof. Therefore, the invention is not limited except as defined in the appended claims.

What is claimed is:

1. Device for recording weaving faults in fabric being manufactured on weaving machines having a withdrawal cylinder by making a written record of said faults on a recording card with symbols indicating the reason for the particular weaving faults comprising drum means mounted on a threaded end of a stationary shaft, a recording card mounted circumferentially on said drum means, transmission means connected to said withdrawal cylinder and coupling said drum means thereto and which transmission means moves at the same speed as advancing fabric being manufactured on said weaving machine and comprises a cam having at least one projection and which is mounted on the shaft of the withdrawing cylinder of the weaving machine, a roller mounted on a swingable lever means and bearing against said cam and a resilient cable connected to said swingable lever at one end and to the drum means at the opposite end, said drum means being provided with a helical, circumferential groove of the same pitch as the threaded end of said stationary shaft, writing means being mounted opposite the helical groove of said drum means and electromagnetic means, including circuit means and switch means connecting said electromagnetic means to at least one stop motion on the stop circuit of said weaving machine.

2. The device as defined in claim 1 including spring means connected to the swingable lever and biasing the roller against the cam.

3. The device as defined in claim 1 including a spring biased pawl connected to the resilient cable and toothed drum means, said pawl engaging the teeth on the drum means.

4. The device as defined in claim 1 wherein the writing means are mounted on a holder fixed to the stationary shaft which supports the drum means.

5. The device as defined in claim 4 wherein the writing means includes a plurality of writing elements.

6. The device as defined in claim 5 wherein the writing elements are of different colors.

* * * * *